US006684457B2

(12) United States Patent
Holt

(10) Patent No.: US 6,684,457 B2
(45) Date of Patent: Feb. 3, 2004

(54) ADJUSTABLE AND REVERSIBLE HINGE ASSEMBLY

(75) Inventor: David Holt, Cols., OH (US)

(73) Assignee: Liebert Corporation, Columbus, OH (US)

( * ) Notice: Subject to any disclaimer, the term of this patent is extended or adjusted under 35 U.S.C. 154(b) by 28 days.

(21) Appl. No.: 09/866,365

(22) Filed: May 25, 2001

(65) Prior Publication Data

US 2002/0023311 A1 Feb. 28, 2002

Related U.S. Application Data

(60) Provisional application No. 60/207,027, filed on May 25, 2000.

(51) Int. Cl.[7] ..... E05D 7/10; E05D 5/06

(52) U.S. Cl. ..... 16/387; 16/362; 16/389

(58) Field of Search ..... 16/387, 389, 390, 16/253, 262

(56) References Cited

U.S. PATENT DOCUMENTS 1,660,657 A * 2/1928 Regan ..... 16/234
2,587,818 A * 3/1952 Caldwell et al. ..... 16/389
2,839,779 A * 6/1958 Haag ..... 16/375
3,171,157 A * 3/1965 Loughlin ..... 16/390
3,298,135 A * 1/1967 Kinser ..... 16/262
4,424,607 A * 1/1984 Langenhorst ..... 16/38
D272,597 S * 2/1984 Cascone et al. ..... 16/387
4,658,471 A * 4/1987 Nakanishi ..... 16/386
4,864,688 A * 9/1989 Gerber ..... 16/261
4,873,744 A * 10/1989 Johnson, Jr. ..... 16/247
5,033,161 A * 7/1991 Chavez ..... 16/254
5,666,695 A * 9/1997 Jegers et al. ..... 16/380
5,722,121 A * 3/1998 Lau et al. ..... 16/381
6,070,297 A * 6/2000 Borer ..... 16/266

* cited by examiner

*Primary Examiner*—Robert E. Pezzuto
*Assistant Examiner*—Alexandra K. Pechhold
(74) *Attorney, Agent, or Firm*—Howrey Simon Arnold & White, LLP

(57) ABSTRACT

A recessed hinge is disclosed that allows a door to open to an angle greater than 90 degrees. The hinge has a hinge pin with two free ends so that the hinge is also fully reversible, for use either on the right hand or left of an enclosure. The hinge also provides for simplified horizontal adjustment by having oval mounting holes for attaching the hinge to the enclosure, and the hinge provides for vertical adjustment by disposing one or more washers on the free end of the hinge pin. Vertical adjustment of the door as well as door removal may be accomplished without tools.

16 Claims, 5 Drawing Sheets

ADJUSTABLE AND REVERSIBLE HINGE ASSEMBLY

CROSS REFERENCE TO RELATED APPLICATION AND PRIORITY CLAIM

This application claims the benefit of Provisional U.S. Patent Application Serial No. 60/207,027, entitled "Adjustable and Reversible Hinge Assembly", naming the same inventor as identified herein and filed May 25, 2000.

BACKGROUND OF THE INVENTION

Available hinges have a number of disadvantages that are particularly noticeable when expanded access to the interior of an enclosure is required. First, for all but the smallest of doors, it is extremely difficult for a single person to remove the door. This is because door removal typically requires one or more tools, which must be manipulated by the worker while the door is also supported by the worker. Second, it is typically difficult to adjust the hinges so that the doors close with the proper horizontal and vertical clearances. This difficulty arises because of the design of the hinges and the tools required to accomplish such adjustment. Third, many hinges are not reversible for use with a right or left hand door.

SUMMARY OF THE INVENTION

The present invention is directed to a hinge that overcomes many limitations of prior art hinges. Specifically, the hinge of the present invention is easily reversible for use as a left hand or right hand hinge. Further, the hinge of the present invention is easily adjustable, both horizontally and vertically. Additionally, the hinge of the present invention permits adjustment and door removal without the use of tools.

The hinge of the present invention is comprised of a hinge pin assembly and a hinge receptacle assembly. The hinge pin assembly is mounted on the doorpost of an enclosure and is fully reversible for left hand or right hand use. The hinge receptacle assembly is mounted on the door to the enclosure and is also fully reversible. Horizontal adjustment of the door is accomplished by horizontal displacement of the hinge pin assembly, which is accomplished using the mounting apparatus for the hinge assembly. The hinge assembly mounting apparatus is designed to easily accommodate such adjustments. Vertical adjustment of the door is accomplished by adjusting the height of the hinge receptacle assembly relative to the hinge pin assembly, which is accomplished by inserting one or more washers between the hinge pin assembly bearing surface and the hinge receptacle assembly bearing surface. In a preferred embodiment of the invention the hinges are comprised of nylon to minimize friction. Finally, the door may be simply removed while in the open position by lifting the door and hinge receptacle assembly off the hinge pin assembly. Door removal is readily accomplished by one person, without the use of tools.

DESCRIPTION OF ILLUSTRATIVE EMBODIMENTS

Figure 1:
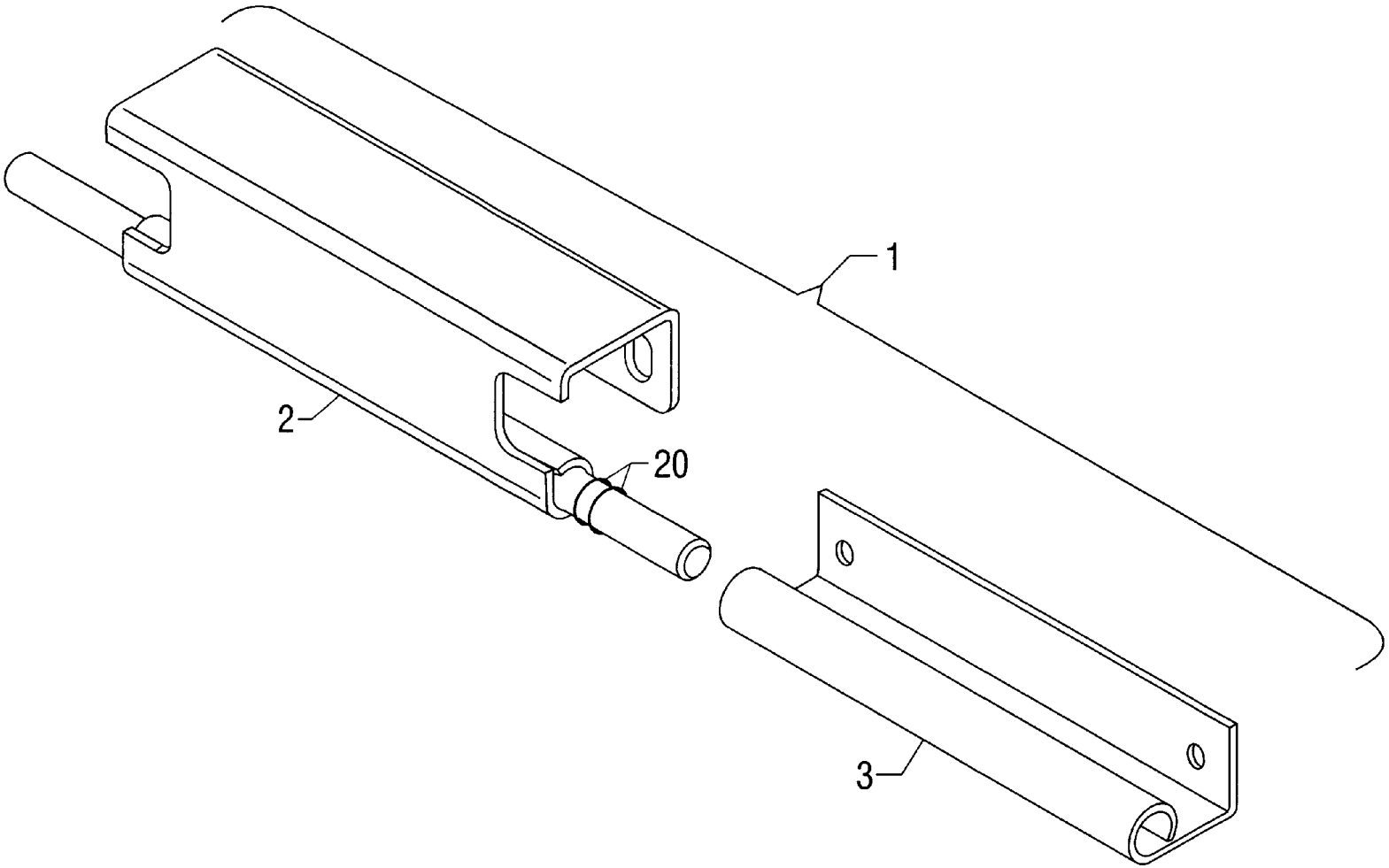
FIG. 1 is an illustration of a hinge in accordance with the present invention.
Figure 2A:
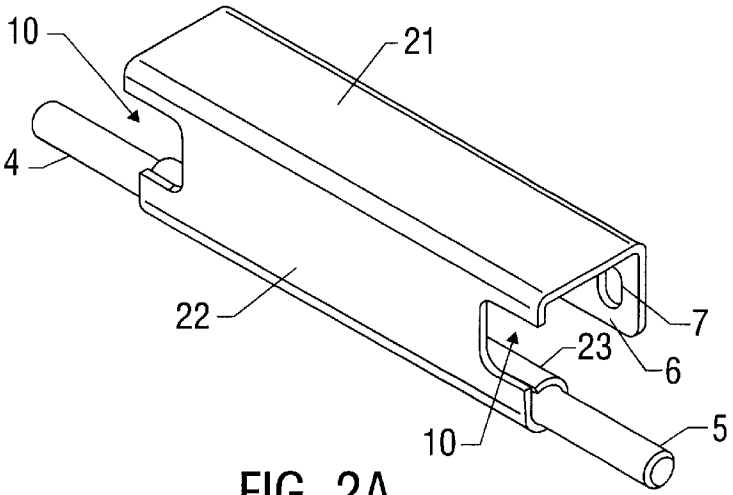
FIG. 2A illustrates a hinge pin assembly in accordance with the present invention.
Figure 2B:
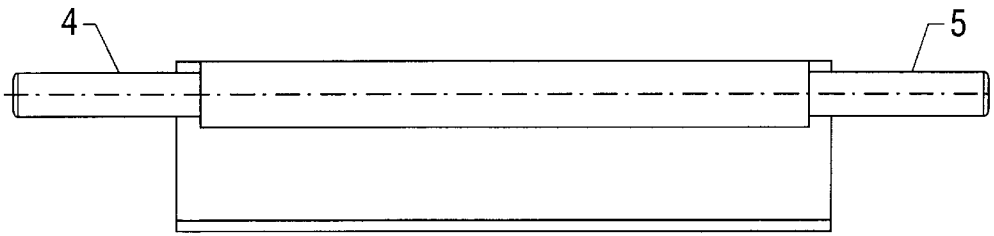
FIG. 2B is a front view of a hinge pin assembly in accordance with the present invention.
Figure 2C:
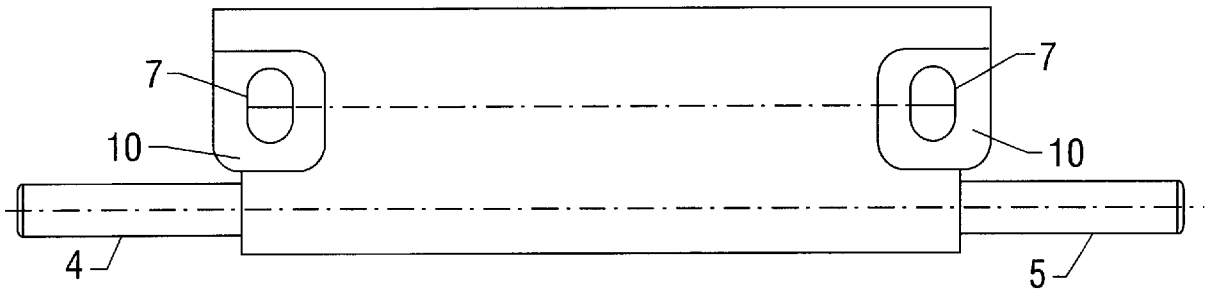
FIG. 2C is a top view of a hinge pin assembly in accordance with the present invention.
Figure 2D:
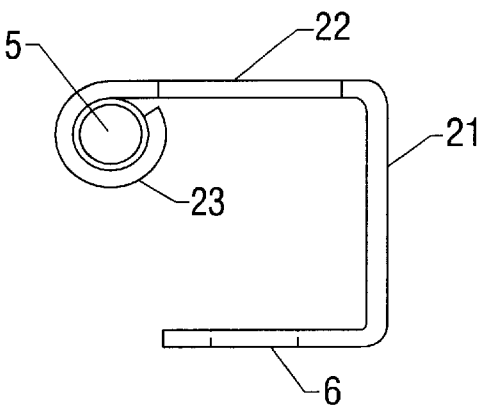
FIG. 2D is an end view of a hinge pin assembly in accordance with the present invention.
Figure 3B:
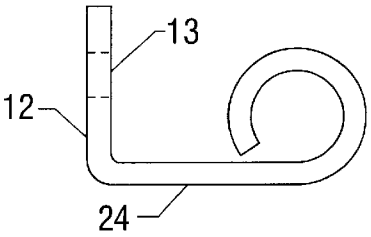
FIG. 3B is an end view of a hinge receptacle assembly in accordance with the present invention.
Figure 3D:
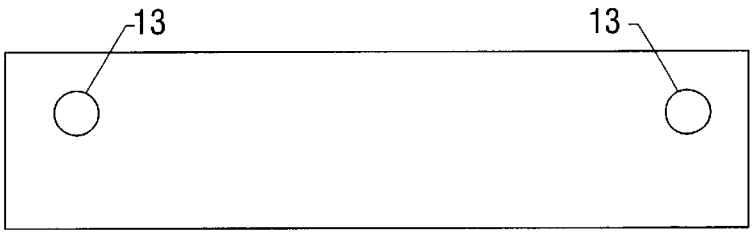
FIG. 3D is a side view of a hinge receptacle assembly in accordance with the present invention.
Figure 3A:
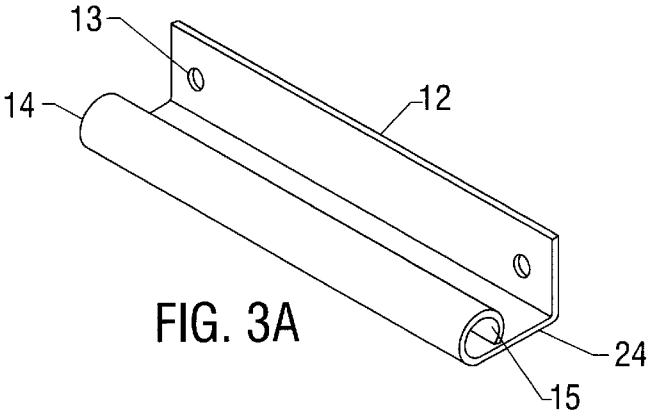
FIG. 3A illustrates a hinge receptacle assembly in accordance with the present invention.
Figure 3C:
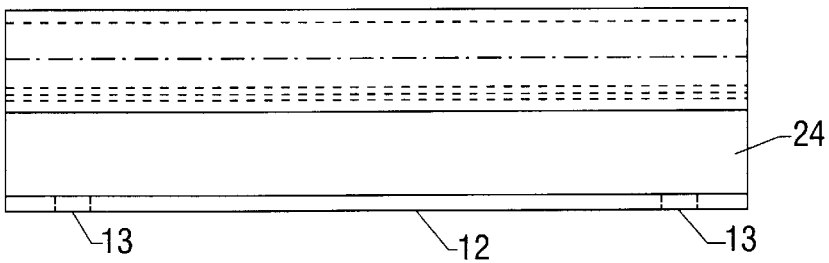
FIG. 3C is a top view of a hinge receptacle assembly in accordance with the present invention.

A hinge in accordance with the present invention is illustrated in FIG. 1. The hinge 1 is comprised of two portions, hinge pin assembly 2 and hinge receptacle assembly 3. The hinge is designed to allow both horizontal and vertical adjustment. Furthermore, the hinge is reversible for use as either a left hand or a right hand hinge. Finally, the hinge also designed so that the door may be removed or vertically adjusted without the use of tools.

Hinge pin assembly 2 is further illustrated in FIGS. 2A–2D. Hinge pin assembly 2 comprises left hand hinge pin 4, right hand hinge pin 5, hinge pin retainer 23, mounting flange 6, first face 21, second face 22, mounting holes 7, and cutouts 10. In one embodiment, the entirety of hinge pin assembly 2, with the exception of hinge pins 4 and 5, is formed from a single piece of steel or other suitable material. In an alternative embodiment, the entirety of hinge pin assembly 2 is formed from a single piece of metal. One particular embodiment of the hinge pin assembly may be formed from a piece of 16 gauge steel, which has an approximate thickness of 1.52 millimeters, with dimensions of 3.5 inches by 3.75 inches or 95.2 millimeters by 88.9 millimeters. A 90 degree bend is formed parallel to the shorter edge at a distance of approximately 0.75 inch or 19.1 millimeters from the shorter edge. The 0.75 inch wide portion bounded by the shorter edge and the 90 degree bend forms mounting flange 6. Two mounting holes 10, oval in shape, are drilled with centers approximately 0.25 inch or 6.4 millimeters from the longer edge. The holes are centered between the longer edge and the 90 degree bend defining the mounting flange.

Proceeding further along the steel piece, another 90 degree bend is formed parallel to the first, offset by a distance approximately 0.93 inch or 23.6 millimeters. The surface between the two bends forms first face 21. Again proceeding along the steel piece, a bend of approximately 300 degrees is formed beginning at a distance of approximately 0.94 inch from the second 90 degree bend. The area bounded by the second 90 degree bend and the 300 degree bend forms second face 22. This final bend results in the second shorter edge being disposed against the back of second face 22, forming approximately cylindrical hinge pin retainer 23.

Two cutouts 10 are removed from either edge of second surface 22. The notches are cut opposite mounting holes 7 to allow access thereto. The cutouts are approximately 0.50 inch or 12.7 millimeters wide and 0.55 inch or 14.0 millimeters high centered approximately over the mounting holes 7 drilled in mounting flange 6.

Left hand hinge pin 4 and right hand hinge pin 5 are the two ends of a single steel rod 0.25 inch in diameter and approximately 5.75 inches in length. The rod is inserted into cylindrical hinge pin retainer 23 and spot welded in place.

After fabrication, the entire hinge pin assembly is zinc plated to provide corrosion resistance.

Figure 4:
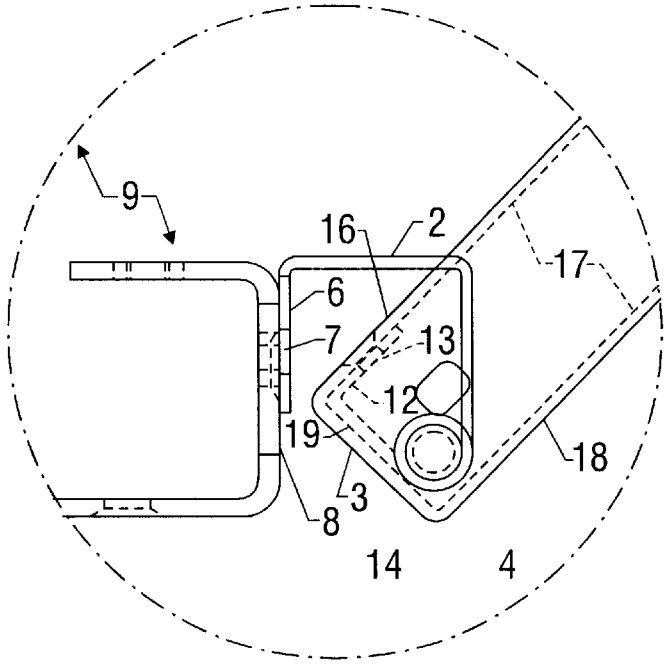
FIG. 4 shows the mounted hinge and door in the open position.
Figure 5:
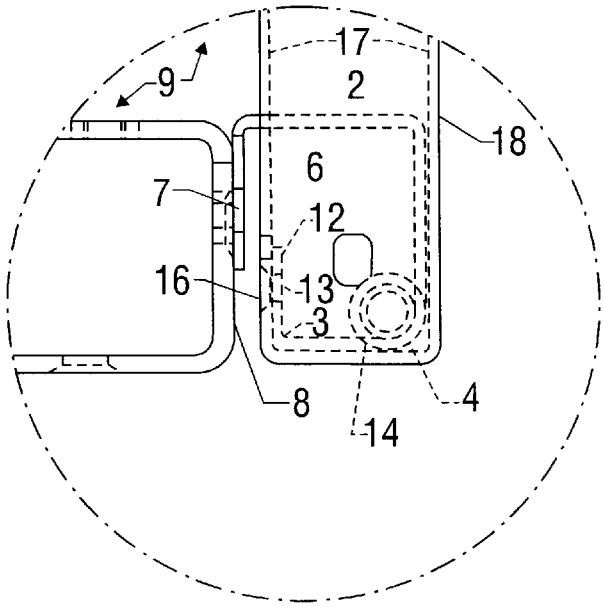
FIG. 5 shows the mounted hinge and door in the closed position.

Mounting of the hinge pin assembly is illustrated in FIGS. 4 and 5. For mounting as a left hand hinge, mounting flange 6 is disposed against leftmost edge of front face 8 of enclosure 9 with left hand hinge pin 4 pointing upward. Hinge pin assembly 2 is secured to enclosure 9 by inserting screws, bolts, or other suitable fasteners through mounting holes 7 and front face 8. For mounting as a right hand hinge, mounting flange 6 would be disposed against rightmost edge of front face 11 of enclosure 9 with right hand hinge pin 5 pointing upward.

Hinge receptacle assembly 3 is further illustrated in FIGS. 3A–3D. Hinge receptacle assembly 3 further comprises mounting flange 12, mounting holes 13, face 24, left hand hinge receptacle 14, and right hand hinge receptacle 15. The entirety of hinge receptacle assembly 3 is formed from a single piece of steel or other suitable material. One embodiment of hinge receptacle assembly may be formed from a piece of 16 gauge steel, which has an approximate thickness of 1.52 millimeters, with dimensions of 2.75 inches by 2.25 inches or 69.9 millimeters by 57.3 millimeters. A 90 degree bend is formed parallel to the longer edge at a distance of approximately 0.5 inch or 12.4 millimeters from the shorter edge. The 0.5 inch wide portion bounded by the longer edge and the 90 degree bend forms mounting flange 12. Two mounting holes 13 are drilled with centers approximately 0.25 inch or 6.4 millimeters from the shorter edge. The holes are centered between the shorter edge and the 90 degree bend defining the mounting flange.

Proceeding further along the steel piece, a bend of approximately 300 degrees is formed beginning at a distance of approximately 0.573 inch or 14.6 millimeters from the 90 degree bend. This final bend results in the second longer edge being disposed against the back of face 24, forming a cylindrical portion comprising left hand hinge receptacle 14 and right hand hinge receptacle 15.

After fabrication, the entire hinge receptacle assembly is zinc plated to provide corrosion resistance.

Mounting of hinge receptacle assembly is illustrated in FIGS. 4 and 5. For mounting as a left hand hinge, mounting flange 12 is disposed against flange 16 of door 17 with left hand hinge receptacle 14 pointed downward. The outer face 18 of door 17 is disposed parallel to mounting flange 12. Hinge receptacle 3 is affixed to door 17 by screws, bolts, or other suitable fasteners inserted through mounting holes 13 and door flange 16. The entirety of hinge receptacle assembly 3 is disposed within the "C" channel formed by the outer face 18, edge 19, and flange 16 of door 17.

The hinge of the present invention allows the door/hinge assembly to be mounted without the use of tools. To mount the door/hinge assembly, whether in the left hand or right hand configuration, the hinge pin assemblies 2 are affixed to the front face 8 of enclosure 9 as described above. The hinge receptacle assemblies 3 are affixed to the mounting flanges 16 of door 17. Door 17 is then disposed such that each hinge receptacle assembly 3 is located directly above the corresponding hinge pin assembly 2. The door is lowered such that each hinge pin slides into the corresponding hinge receptacle, whether right hand or left The door is held in place vertically by gravity and the door latch assembly. The door is held in place horizontally by the hinge pin and receptacle. The door is opened and closed by rotating the door about the common longitudinal axis of the hinge pin and hinge receptacle. The door may be removed by opening the door and lifting the door such that each hinge receptacle slides off the corresponding hinge pin. Door removal may be accomplished by a single person and without the use of any tool.

The hinge assembly is also designed so that the height of the door may be adjusted. Washers 20 (see FIG. 1) are provided that have an inside diameter approximately equal to the inside diameter of the left and right hand hinge receptacles 14 and 15. The outside diameter corresponds to the outside diameter of the hinge receptacles. The washers may disposed about the hinge pins to increase the height at which the hinge receptacle will come to rest. The thickness of the washer corresponds to the increment by which the door height may be adjusted. The washers may be made from any material sufficient to support the weight of the door assembly. In the preferred embodiment of the invention the washers are made of nylon to reduce friction. In one embodiment of the invention, the thickness of the washer is 1/16 inch, but other thickness may be used as appropriate for the hinge size and door clearance tolerances.

The hinge assembly is designed so that the hinge may be adjusted for horizontal clearance as well. Each of the mounting holes 6 of hinge pin assembly 2 are shaped so that the fastening screw or bolt may be loosened slightly and the hinge pin assembly may be moved horizontally as required to adjust the door position.

Additional modifications and adaptations of the present invention will be obvious to one of ordinary sill in the art, and it is understood that the invention is not to be limited to the particular illustrative embodiments set forth herein. It is intended that the invention embrace all such modified forms as come with in the scope of the following claims.

What is claimed is:

1. A reversible hinge for mounting a removable door on an enclosure, the enclosure having either a left door post or a right door post, the reversible hinge comprising:

a) a hinge pin assembly comprising a door post mounting flange for mounting to either door post, a hinge pin retainer, and a hinge pin, the hinge pin having a first free end and a second free end, the first free end being oriented in an upward direction when the door post mounting flange is mounted to the left door post, the second free end being oriented in the upward direction when the door post mounting flange is mounted to the right door post; and b) a hinge receptacle assembly comprising a door mounting flange and a cylindrical hinge receptacle;

wherein the cylindrical hinge receptacle is disposed about the free end of the hinge pin oriented in the upward direction when mounting the removable door on the enclosure such that the hinge receptacle assembly is transitionally fixed relative to the hinge pin assembly, but freely rotatable about a common axis of the hinge pin and the cylindrical hinge receptacle to effect opening and closing of the removable door.

2. The hinge of claim 1, wherein the cylindrical hinge receptacle comprises a circular opening at each of a first end and a second end of the cylindrical hinge receptacle, the circular opening at the first end being disposed about the first free end of the hinge pin for a left hand mounted door, or the circular opening at the second end being disposed about the second free end of the hinge pin for a right hand mounted door.

3. The hinge of claim 1, wherein vertical placement of the door is adjusted by disposing one or more washers about the free end of the hinge pin oriented in the upward direction, such that the hinge receptacle assembly rests atop the one or more washers rather than the hinge pin retainer.

4. The hinge of claim 3, wherein the washers are comprised of nylon.

5. The hinge of claim 2, wherein vertical placement of the door is adjusted by disposing one or more washers about the free end of the hinge pin oriented in the upward direction, such that the hinge receptacle assembly rests on the one or more washers rather than the hinge pin retainer.

6. The hinge of claim 5, wherein the washers are comprised of nylon.

7. The hinge of claim 1, further comprising a first mounting hole drilled in a first end of the door post mounting flange and a second mounting hole drilled in a second end of the door post mounting flange, the mounting holes being substantially oval in shape, wherein horizontal adjustment of the door is accomplished by horizontal translation of the hinge pin assembly relative to the door post.

8. The hinge of claim 2, further comprising a first mounting hole drilled in a first end of the door post mounting flange and a second mounting hole drilled in a second end of the door post mounting flange, the mounting holes being substantially oval in shape, wherein horizontal adjustment of the door is accomplished by horizontal translation of the hinge pin assembly relative to the door post.

9. The hinge of claim 3, further comprising a first mounting hole drilled in a first end of the door post mounting flange and a second mounting hole drilled in a second end of the door post mounting flange, the mounting holes being substantially oval in shape, wherein horizontal adjustment of the door is accomplished by horizontal translation of the hinge pin assembly relative to the door post.

10. A reversible hinge for mounting a removable door on an enclosure, the enclosure having either a left door post or a right door post, the reversible hinge comprising:

a) a hinge pin assembly comprising a door post mounting flange for mounting to either door post, a hinge pin retainer, and a hinge pin, the hinge pin having a first free end and a second free end, the first free end being oriented in an upward direction for a left hand mounted door and the second free end being oriented in the upward direction for a right hand mounted door; and b) a hinge receptacle assembly comprising a door mounting flange and a cylindrical hinge receptacle, the cylindrical hinge receptacle having a circular opening at each of a first end and second end of the cylindrical hinge receptacle, the circular opening at the first end being disposed about the first free end of the hinge pin for the left hand mounted door, and the circular opening at the second end being disposed about the second free end of the hinge pin for the right hand mounted door;

wherein the cylindrical hinge receptacle is disposed about the hinge pin such that the hinge receptacle assembly is translationally fixed relative to the hinge pin assembly, but freely rotatable about a common axis of the hinge pin and the cylindrical hinge receptacle to effect opening and closing of the removable door.

11. The hinge of claim 10, wherein vertical placement of the door is adjusted by disposing one or more washers about the free end of the hinge pin oriented in the upward direction, such that the hinge receptacle assembly rests on the one or more washers rather than the hinge pin retainer.

12. The hinge of claim 11, wherein the washers are comprised of nylon.

13. The hinge of claim 10, further comprising a first mounting hole drilled in a first end of the door post mounting flange and a second mounting hole drilled in a second end of the door post mounting flange, the mounting holes being substantially oval in shape, wherein horizontal adjustment of the door is accomplished by horizontal translation of the hinge pin assembly relative to the door post.

14. The hinge of claim 11, further comprising a first mounting hole drilled in a first end of the door post mounting flange and a second mounting hole drilled in a second end of the door post mounting flange, the mounting holes being substantially oval in shape, wherein horizontal adjustment of the door is accomplished by horizontal translation of the hinge pin assembly relative to the door post.

15. The hinge of claim 14, wherein the washers are comprised of nylon.

16. An adjustable hinge for mounting a door on a door post comprising:

a) a hinge pin assembly comprising a door post mounting flange, a hinge pin retainer, a hinge pin, and a first mounting hole drilled in a first end of the door post mounting flange and a second mounting hole drilled in a second end of the door post mounting flange, the mounting holes being substantially oval in shape, horizontal adjustment of the door being accomplished by horizontal translation of the hinge pin assembly relative to the door post; and b) a hinge receptacle assembly comprising a door mounting flange and a cylindrical hinge receptacle, vertical placement of the door being adjusted by disposing one or more washers about the hinge pin, the hinge receptacle assembly resting on the one or more washers rather than the hinge pin retainer, wherein the cylindrical hinge receptacle is disposed about the hinge pin such that the hinge receptacle assembly is translationally fixed relative to the hinge pin assembly, but freely rotatable about a common axis of the hinge pin and the cylindrical hinge receptacle to effect opening and closing of the door.

* * * * *

UNITED STATES PATENT AND TRADEMARK OFFICE

CERTIFICATE OF CORRECTION

PATENT NO. : 6,684,457 B2
DATED : February 3, 2004
INVENTOR(S) : David Holt

It is certified that error appears in the above-identified patent and that said Letters Patent is hereby corrected as shown below:

Column 2,
Line 56, delete “transitionally” and insert therefor -- translationally --

Signed and Sealed this

Thirtieth Day of March, 2004

JON W. DUDAS
*Acting Director of the United States Patent and Trademark Office*